US008622112B2

(12) United States Patent
Tremaine, III et al.

(10) Patent No.: US 8,622,112 B2
(45) Date of Patent: Jan. 7, 2014

(54) RETRACTABLE, LOW-PROFILE STORM SHIELD SYSTEMS AND METHODS

(75) Inventors: Burton G. Tremaine, III, Essex, CT (US); Victor Rivera, Port St. Lucie, FL (US)

(73) Assignee: Storm Solutions, Inc., Essex, CT (US)

( * ) Notice: Subject to any disclaimer, the term of this patent is extended or adjusted under 35 U.S.C. 154(b) by 330 days.

(21) Appl. No.: 12/882,331

(22) Filed: Sep. 15, 2010

(65) Prior Publication Data

US 2011/0061822 A1 Mar. 17, 2011

Related U.S. Application Data

(60) Provisional application No. 61/346,490, filed on May 20, 2010, provisional application No. 61/242,466, filed on Sep. 15, 2009.

(51) Int. Cl.

| | |
|---|---|
| ***A47G 5/02*** | (2006.01) |
| ***E06B 9/56*** | (2006.01) |
| ***A47H 1/00*** | (2006.01) |

(52) U.S. Cl.
USPC ..... 160/273.1; 160/264

(58) Field of Classification Search
USPC ..... 160/273.1, 309
See application file for complete search history.

(56) References Cited

U.S. PATENT DOCUMENTS

| | | | | |
|---|---|---|---|---|
| 2,132,986 | A * | 10/1938 | Julien | 160/267.1 |
| 2,815,179 | A * | 12/1957 | Keljik | 242/389 |
| 4,673,019 | A * | 6/1987 | Silverthorne et al. | 160/268.1 |
| 6,691,761 | B1 * | 2/2004 | Alkhoury et al. | 160/273.1 |
| 6,873,461 | B1 * | 3/2005 | McPherson, Jr. | 359/461 |
| 7,128,125 | B2 * | 10/2006 | Harbison | 160/273.1 |
| 7,360,575 | B2 * | 4/2008 | Weiss | 160/273.1 |
| 7,413,000 | B2 * | 8/2008 | Lin | 160/310 |

* cited by examiner

*Primary Examiner* — Katherine Mitchell
*Assistant Examiner* — Jeremy Ramsey
(74) *Attorney, Agent, or Firm* — Troutman Sanders LLP; Robert R. Elliott, Jr.

(57) ABSTRACT

A system for protecting building penetrations is disclosed. The system can include a screen comprising flexible, strong fabric-like material suitable for resisting high winds, driving rain, and wind-driven missiles. The screen can further include loops sewn, or otherwise manufactured, into the span sides of the screen. The system can further include one or more retention channels having an internal hem rod. The loops in the screens can slide over the hem rod to guide and retain the screen in the retention channels. The hem rod can include a tapered end and a loop opener to facilitate the loops sliding over the end of the hem rod. The system can further include an enclosure for housing a take-up roll and a powered or manual rotating system. The system can include a deflection device to enable the screen to unroll off the take-up roll smoothly and vertically.

16 Claims, 14 Drawing Sheets

RETRACTABLE, LOW-PROFILE STORM SHIELD SYSTEMS AND METHODS

CROSS REFERENCE TO RELATED APPLICATIONS

This application claims benefit under 35 USC §119(e) of U.S. Provisional Patent Application Ser. No. 61/242,466 filed 15 Sep. 2009 and U.S. Provisional Patent Application Ser. No. 61/346,490 filed 20 May 2010. Both applications are hereby incorporated fully herein by reference.

BACKGROUND OF THE INVENTION

1. Field of the Invention

The present invention relates to a retractable system for protecting penetrations in buildings, and particularly to a retractable, flexible, low-profile, solar, insect, thermal, and storm protection system for windows and doors. The present invention enables a storage and deployment mechanism for roll-up storm protection screens that is approximately 70% smaller than conventional systems while containing approximately 50% greater vertical length of material. This smaller size eases installation and reduces the aesthetic impact of the system on the installation site. Space savings are maintained or improved as the size of the system increases, e.g., to protect larger openings.

2. Background of Related Art

Systems exist that attempt to mitigate damage to structures during inclement weather such as hurricanes, cyclones, nor'easters, and thunderstorms. These types of weather systems can carry with them high winds, hail, sleet, and driving rain. High winds can damage structures not only by creating high pressure forces and, for example, blowing windows out, but also by causing loose material and debris to become missiles impacting the structure. In addition, high winds can create driving rain that can penetrate, among other things, window and door seals causing flooding and water damage to the structure.

"Bahama," or colonial-type, conventional storm shutters have been used in an attempt to protect windows and doors during storms. These shutters are typically constructed of a rigid material such as, for example, wood, plastic, or metal, and are sized to cover the opening they protect. These types of shutters typically use a heavy and awkward safety bar to secure the shutters for use. Due in part to their custom construction, however, Bahama storm shutters tend to be expensive, heavy, and can be difficult to deploy.

Aluminum roll-up shutter systems are also available. These systems use multiple aluminum panels joined by hinges or pins to form a substantially solid but flexible curtain, similar to a roll-up garage door. These systems are generally available with electric or manual crank deployment. Due to the thickness of the aluminum panels, however, the systems tend to be heavy. Additionally, due to the limited range of motion of the hinges that join the panels, the take-up rolls that store aluminum shutters when not in use are large. As a result, the enclosures for these systems are necessarily large and cumbersome. This makes installation difficult and detracts from the aesthetics of the building on which they are installed. In addition, aluminum roll-up systems are opaque and block most, if not all, of the natural light from the building when deployed. This provides a dark and unpleasant experience to the user, especially given that the power to the building is likely out.

In an attempt to reduce cost and increase protection, retractable storm protection systems have been developed.

These systems typically use a strong, flexible, fabric curtain or screen made of, for example, polypropylene, PVC, Kevlar®, Mylar®, or hybrids thereof. The systems can further comprise a retracting mechanism and a housing in which to store the screen when not in use. The screen is deployed to cover the window and is generally retained in vertical tracks installed in, or on, the window opening. Conventionally, the screen is retained in the track either by sewing a hem cord to the vertical sides of the curtain (as used herein, the "hem cord method"), or simply by folding the curtain over on itself to form a hem (as used herein, the "hem-only method").

At one end of the spectrum, a hem cord sewn to the edges of the curtain enables the curtain to be retained in a slotted track because the slot is considerably smaller than the diameter of the hem cord. This method retains the curtain in the track at fairly high forces because the diameter of the hem cord is sufficiently large when compared to the slot in the track. Unfortunately, the thick, stiff hem cord requires a large diameter take-up roll on which to retract the curtain (i.e., when the curtain is not deployed). This, in turn, necessitates a large housing, increasing installation difficulty and detracting from the aesthetics of the building, among other things.

At the other end of the spectrum, the hem-only method involves a hem sewn into the edge of the curtain that can enable it to be retained in a sufficiently small slot in the track. Because the hem is generally only approximately twice the thickness of the fabric itself, this method has a limited ability to retain the curtain in the track. As a result, the application of such systems is limited to smaller openings to minimize pressure forces on the curtain. In other words, at larger opening sizes, such as a large door, the force created by high winds can exceed the ability of the system to retain the curtain. Additionally, the necessarily tight slot in the retaining track can cause jams and hinder operation when deploying or retracting the curtain.

What is needed, therefore, is a system that combines the retention strength of the conventional hem cord system, with the reduced storage requirements of the hem-only method. It is to such a system that embodiments of the present invention are primarily directed.

BRIEF SUMMARY OF THE INVENTION

Embodiments of the present invention relate generally to storm protection systems and more specifically to a flexible, retractable storm protection system with a reduced volume and increased protection. The system can comprise a curtain or screen made of a strong flexible material, or a composite of such materials. The screen material can comprise, for example and not limitation, Kevlar®, Mylar®, vinyl, PVC, nylon, or fiberglass, or combinations thereof. The screen can comprise a loop sewn into both vertical edges.

The present system can further comprise vertical channels for securing the vertical edges of the screen. The vertical channels can be substantially C-shaped with a hem rod located inside the channel. The loops in the vertical sides of the screen can encircle the hem rod such that the screen is both guided inside the channel, when being deployed or retracted, and retained in the channel when the screen encounters wind pressure or other forces. The hem rod acts to locate and secure the screen in substantially the same manner as a conventional hem cord, while significantly reducing storage requirements for the screen when retracted.

In some embodiments, the system can be installed on the outside of a building penetration, such as for example and not limitation, a door or a window. In this configuration, the system can also protect the door or window from solar heat gain, insect or pest infiltration, and thermal loss, in addition to storm and water damage. In some embodiments, the system can be installed on the inside of a building penetration. In this configuration, the system can provide the same protections for the building, and limited protection for the door or window, for example.

In some embodiments, the system can be mounted in the upper portion of a penetration and deployed from the top down (as used herein, the "top-down configuration") and can be manually or electrically deployed. In other embodiments, the system can be mounted in the bottom end of a penetration and deployed from the bottom up (as used herein, the "bottom-up configuration") and can be electrically or manually deployed.

The system can further comprise a horizontal support unit. The horizontal support unit can span all, or substantially all, of the free horizontal edge of the screen (i.e., the end of the screen not attached to the take-up roll). In some embodiments, such as when the top-down configuration is used, the horizontal support unit can be weighted and can facilitate the deployment of the screen. In other embodiments, such as when the bottom-up configuration is installed, the horizontal support unit can comprise a lightweight, rigid material. In some embodiments, the horizontal support unit can further comprise, for example and not limitation, latches, catches, or pins for securing the screen in the deployed, or partially deployed, position.

Embodiments of the present invention can also comprise a method for installing the system on a penetration. The method can comprise affixing one or more C-shaped channels on the sides of the building penetration. An enclosure can then be installed in the top or bottom of the penetration. A screen comprising a horizontal support bar can then be installed to protect the penetration. The system can be installed in a bottom-up configuration. The system can also be installed in a top-down configuration. The method can further comprise installing a manual or electric drive system.

These and other objects, features and advantages of the present invention will become more apparent upon reading the following specification in conjunction with the accompanying drawing figures.

DETAILED DESCRIPTION OF THE INVENTION

Embodiments of the present invention relate generally to storm protection systems and more specifically to a flexible, retractable storm protection system with a reduced storage volume and increased protection than that conventionally provided. The system replaces a conventional hem cord design with a stationary hem rod located in a retention channel to provide the security of the hem cord system with the compact size of a hem-only system. The system can employ a retention channel with a hem rod disposed therein. The screen can have a loop sewn into each vertical edge sized to easily slip over the hem rod. The hem rod can retain the curtain in the retention track even when exposed to, for example, high wind, driving rain, and/or impacts from flying objects.

To simplify and clarify explanation, the system is described below as a system for protecting the windows and doors of residential and commercial buildings. One skilled in the art will recognize, however, that the invention is not so limited. The system can also be deployed to protect other penetrations in most structures during inclement weather or other environmental or man-made threats. Embodiments of the present invention can also be used, for example, to provide protection for residential and commercial properties against vandalism and break-ins.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. The dimensions listed in the various drawings are for illustrative purposes only and are not intended to be limiting. Other dimensions and proportions are contemplated and intended to be included within the scope of the invention.

A problem with conventional storm protection systems has been that the housings required to store the screens for these systems are undesirably large. The relatively large enclosure for the Armor Screen® Hurricane Protection System by the Armor Screen Corporation, for example, is dictated by the fact that the hem cord product sewn into the edges of the screen requires that a material be wound on approximately a 6" diameter take-up device. The large size of the take-up device is due predominantly to the stiff nature of the hem cord installed in the polypropylene screen material used by Armor Screen®. This hem cord is what guides the screen down each side of the door or window opening and secures the screen in a retention channel on both sides.

Figure 1A:
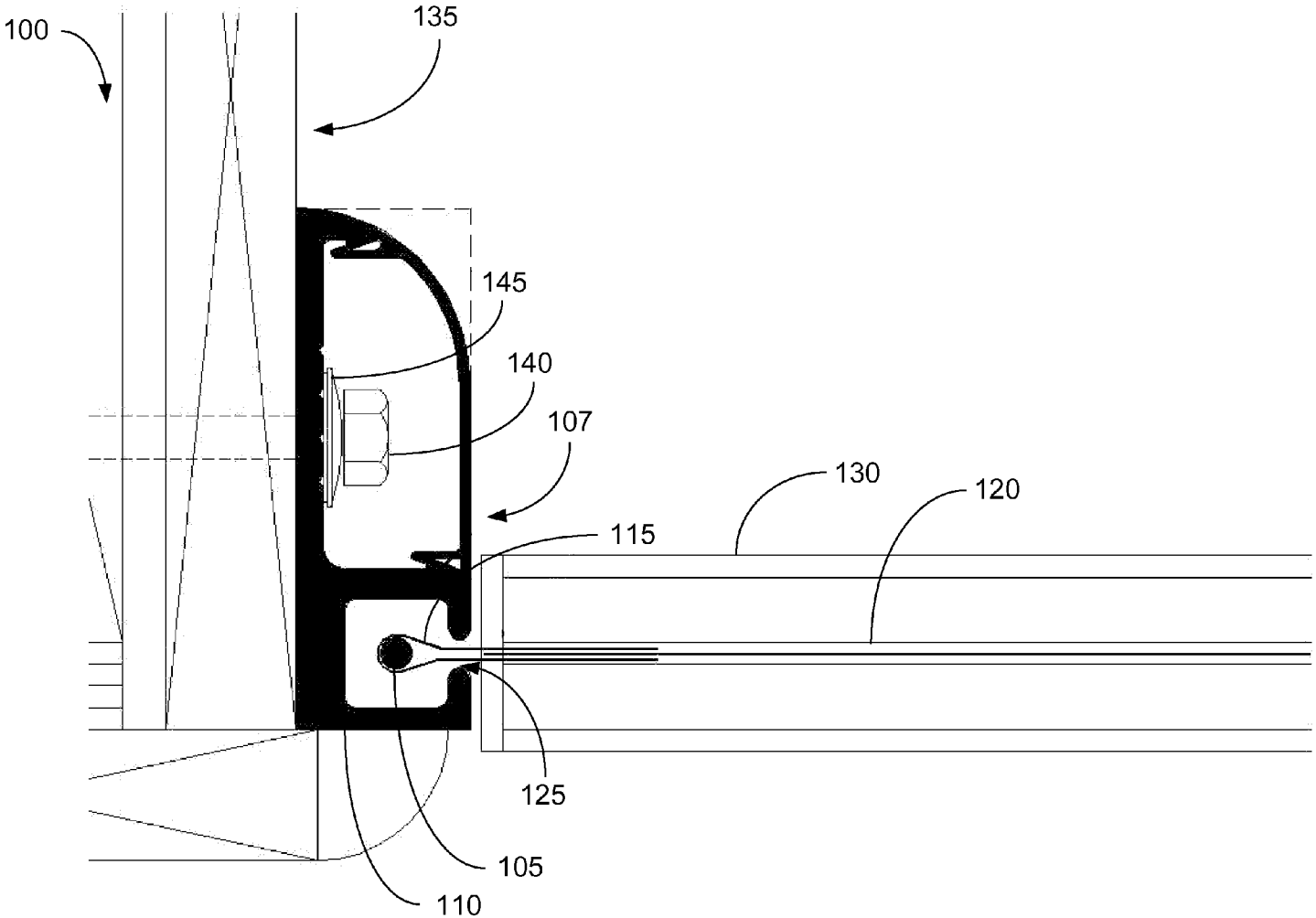
FIG. 1*a* depicts a top, detailed view of a retention track and enclosure for a storm shield system, in accordance with some embodiments of the present invention.
Figure 1B:
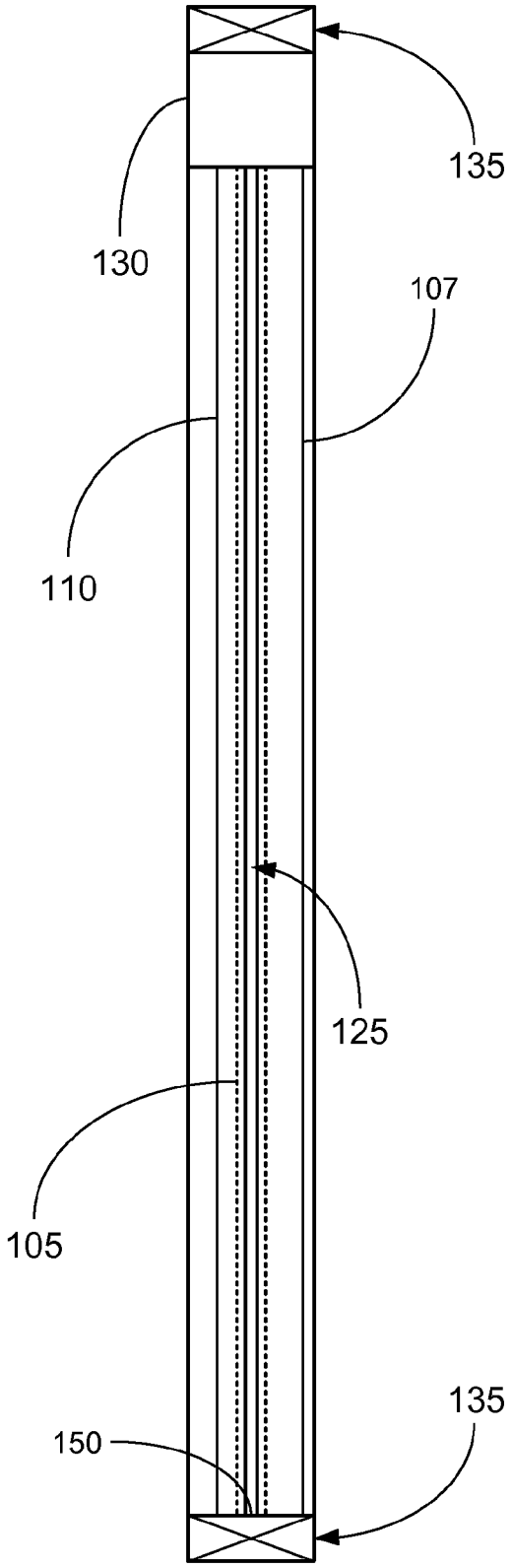
FIG. 1*b* depicts a side view of a retention track and enclosure for a storm shield system, in accordance with some embodiments of the present invention.

In response, as shown in FIGS. 1*a* and 1*b*, embodiments of the present invention relate to a system 100 in which the traditional rope bolt, or hem cord, can be replaced by inserting a side support unit 107 comprising a fixed rod 105 inside a C-channel extrusion 110. A loop 115 can then be sewn into the vertical sides of the screen 120 to slide down the rod 105 and can secure the fabric inside the extrusions 110. With the hem cord removed from the screen 120, the material can be flexible enough to be wound onto, for example and not limitation, a 2" diameter take-up device.

The hem rod 105 (as opposed to a hem cord) can enable a storage and deployment mechanism 200 that is approximately 70% smaller than conventional systems while containing approximately 50% greater vertical length of material. The result is a compact enclosure 130 that can, for example, contain approximately 90 vertical inches of screen in a box 130 that is smaller than 4"×4". For comparison, the smallest Armor Screen® box is 7"×7" and accommodates a maximum of 60 vertical inches of screen. The smaller enclosure 130 can ease installation and reduce the aesthetic impact of the system 100 on the installation site. Space savings are maintained or improved as the size of the system increases, e.g., to protect larger openings.

Various materials, and combinations of materials, can be used to construct the protection screen 120. The screen 120 can provide, for example and not limitation, solar, insect, thermal, and storm ("SITS") mitigation attributes. The screen 120 can comprise a material that meets local, national, or international hurricane, building, and safety codes.

In some embodiments, the screen 120 can be deployed using an extrusion 110, e.g., an extruded C-channel 110, such that the loop 115 sewn into, or attached to, the screen 120 can be slid down a hem rod 105 mounted inside the channel 110. In this configuration, the loop 115 in the screen 120 can slide down over the hem rod 105 and can be retained in the slot 125 of the channel 110 by the hem rod 105. In other words, the present hem rod 105 replaces the hem cord or similar material used in commercially-available hem cord-type products. The channel 110 can be extruded, formed, machined, or fabricated as a single or multi-piece device. The hem rod 105 can be retained at a first end 150 of the channel, e.g., the end 150 in which the screen is considered fully deployed.

When the box 130 is mounted in the top of an opening 135 and the screen 120 is vertically deployed downwardly, for example, the hem rod 105 can be anchored at the bottom end 130 of the channel 110. The hem rod 105 can be made from many materials that enable it to stand vertically without support. The rod 105 can be made from, for example and not limitation, metal, plastic, fiberglass, composite material, wood, or combinations thereof. The diameter of the rod can be sufficiently larger than the slot in the channel such that the material cannot be pulled through the slot.

Figure 2:
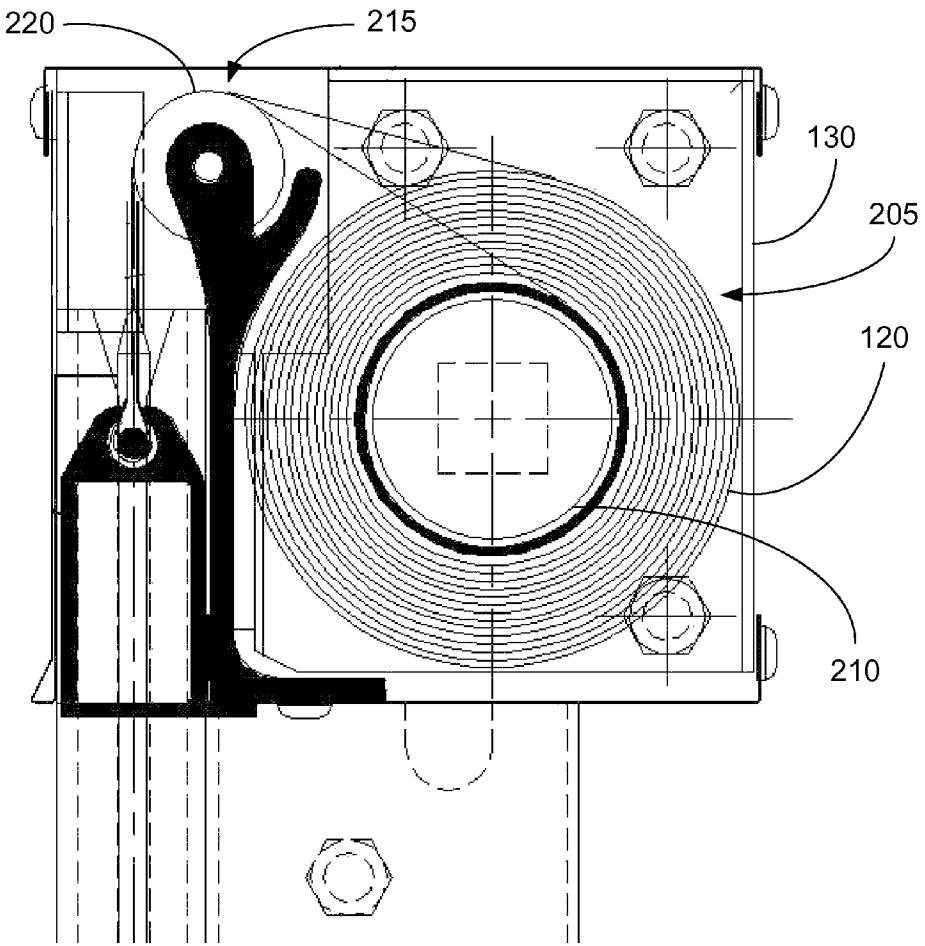
FIG. 2 depicts a cross-sectional view of the enclosure with a roller-type deflector, in accordance with some embodiments of the present invention.
Figure 3:
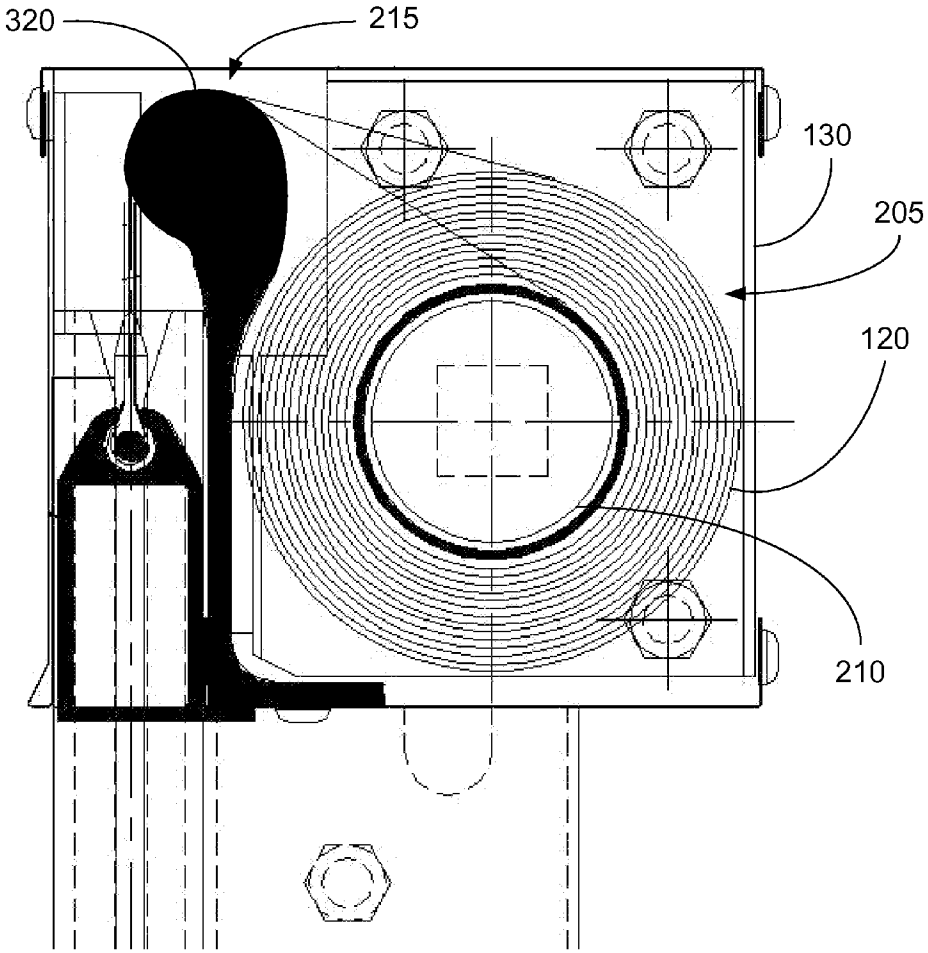
FIG. 3 depicts a cross-sectional view of the enclosure with a smooth-type deflector, in accordance with some embodiments of the present invention.

As shown in FIGS. 2 and 3, the screen 120 can be wound onto a take-up cylinder 210 for storage. The take-up cylinder 210 can be rotated by, for example and not limitation, an electric motor inside the cylinder, a powered or manual end-mounted gear drive, or by a spring type device. A combination of one or more of these devices can also be utilized within a single operating unit to facilitate both powered and manual operation. This feature can be useful if, for example, the power to the building is interrupted. A spring, such as a torsional spring for example, can be added to provide assistance to the electric motor or manual gear drive. These driving mechanisms can be utilized when the screen 120 is deployed in the top-down configuration or the bottom-up configuration.

In some embodiments, the deployment mechanism 205 can comprise a deflector 215. The deflector 215 can enable the material of the screen 120 to be deployed or retracted vertically such that the angle of the screen 120 is substantially constant, regardless of the length of screen 120 on the take-up roll 210 (i.e., the diameter of the take-up roll 210 increases as the screen 120 is retracted). In other words, the material 120 is always deployed such that the angle of entry or exit from the enclosure 130 is vertical. The deflector 215 can comprise many appropriate systems including, but not limited to, one or more rollers 220 (FIG. 2) or a smooth, rounded surface or profile 320 (FIG. 3). In some embodiments, the deflector 215 can further comprise non-friction or other coatings to facilitate screen 120 deployment. The deflector 215 enables the size of the box 130 to be further reduced by smoothly, but sharply, turning the screen 120 fabric from the roll 210 to a vertical position. This enables the screen 120 fabric to turn through a much larger angle than would otherwise be possible without damaging or tangling the fabric.

Figure 4:
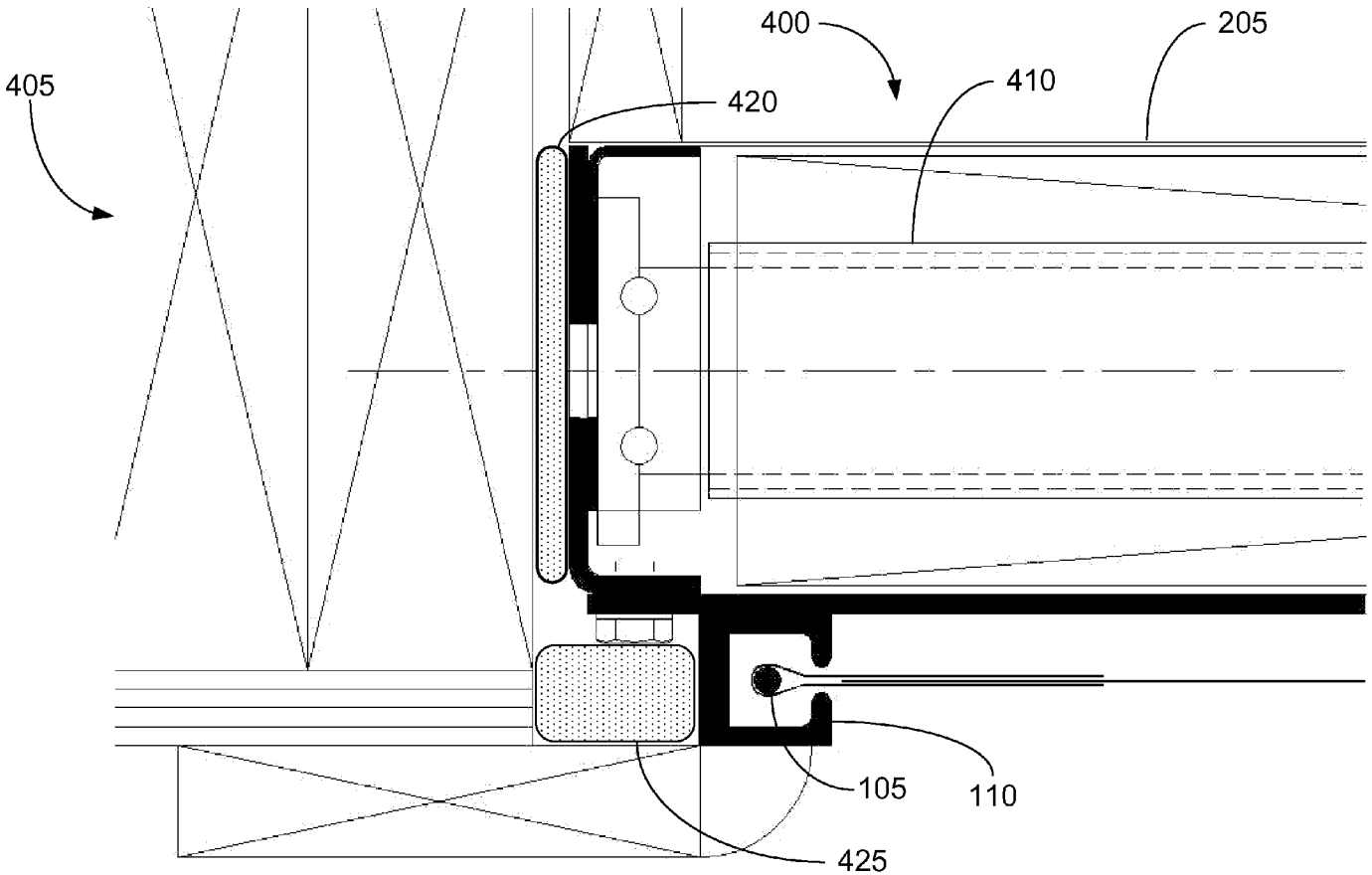
FIG. 4 depicts a detailed view of the enclosure and retention track installed in a trapped configuration, in accordance with some embodiments of the present invention.
Figure 5:
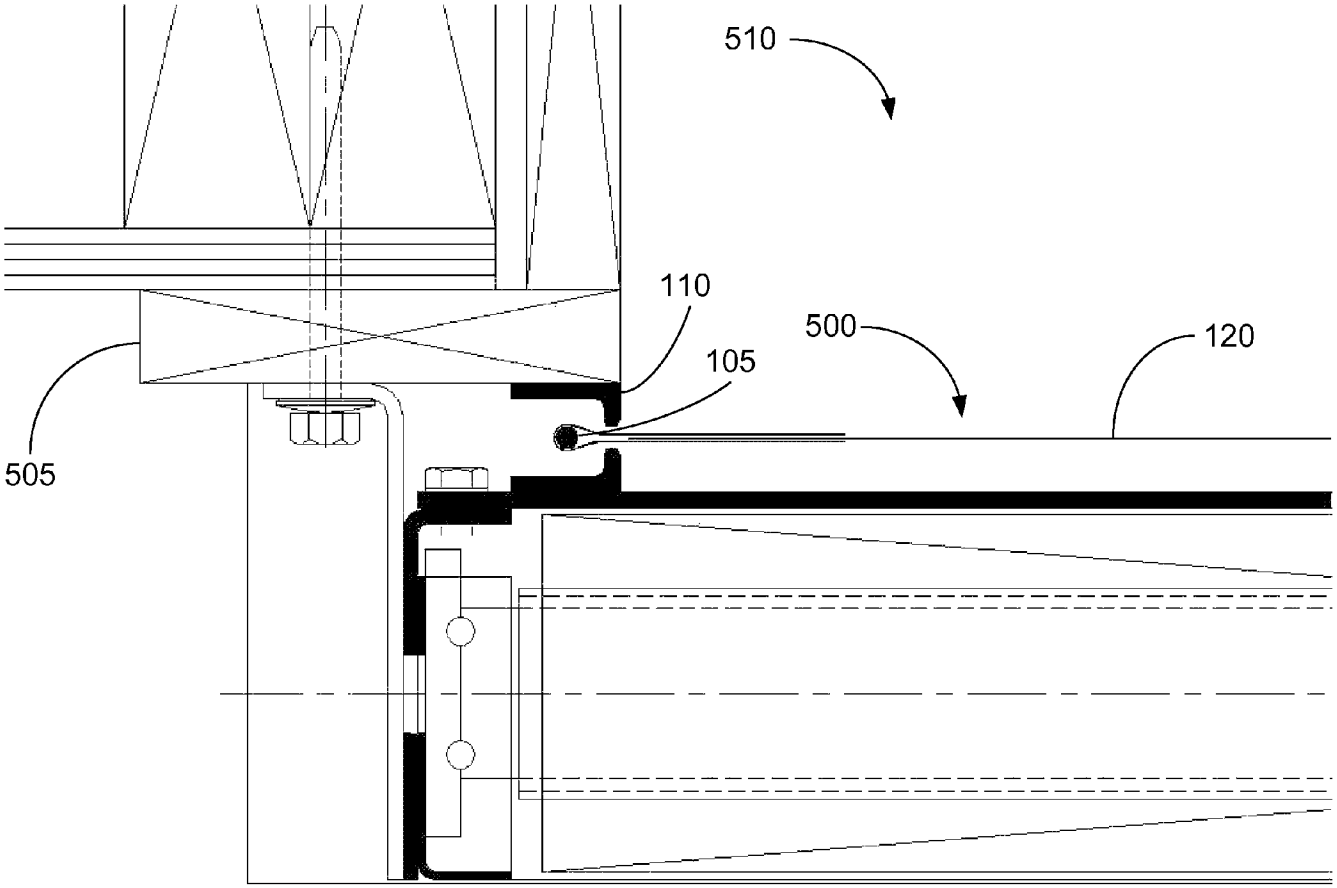
FIG. 5 depicts a detailed view of the enclosure and retention track installed in a face-mounted configuration, in accordance with some embodiments of the present invention.

As shown in FIGS. 4 and 5, the system 400, 500 can be utilized in both a trapped configuration 400 face-mounted configuration 500. A trapped configuration 400 can be installed inside a window or door opening 405 with the take up mechanism 410 and retention mechanisms 105, 110 all being located within the opening 405. The face-mounted installation 500, on the other hand, can be attached to the outside surface, or trim 505, of the opening 610. Both the trapped 400 and face-mounted 500 units can be operated either with the box 130 on the top with the screen 120 going down (the "top-down configuration") or the box 130 mounted on the bottom with the screen 120 going up (the "bottom-up configuration").

As shown in FIG. 4, a trap-mounted unit 400 is installed inside and at the top or bottom of a window or door opening 405, for example, with the vertical extrusions 110 containing the hem rod 105 mounted inside the opening 405. As shown in FIG. 5, a face-mounted unit 500 is attached on the trim 505 above or below and outside the opening 510 with the extrusions 110 containing the fixed hem rod 105 mounted on the vertical trim 505 outside the opening 510. Both of these installations can be made architecturally discreet and installed in a variety of ways that reduce, or eliminate, their visual impact on the structure. In the case of the new construction, the trap-mounted system 400 allows for the box 205 and extrusions 110 to be built into the window or door opening 405 in such a way that they are virtually indistinguishable from a regular opening.

The system 400, 500 can also be installed on the inside or the outside of the opening. In other words, it can be installed in front of, or behind, the window or door. When installed on the outside of the window or door, the system 400, 500 can provide additional protection against, among other things, storm damage caused by wind, wind driven missiles, and driving rain. The system 400, 500 can also help reduce solar heat gain, thermal losses, and insect and pest infiltration. In some embodiments, the system 400, 500 can also provide additional insulation value to the structure thereby reducing energy costs.

In some embodiments, the system 400, 500 can be installed inside of the window or door (i.e., inside the building). The system 400, 500 can provide the benefits listed above in this configuration, with the obvious exception of storm protection for the outside of the window or door itself. However, this configuration may be useful, for example and not limitation, with certain windows (e.g., casement windows) or out swinging doors. In addition, this configuration enables the screens to be easily deployed from inside the building.

Figure 6:
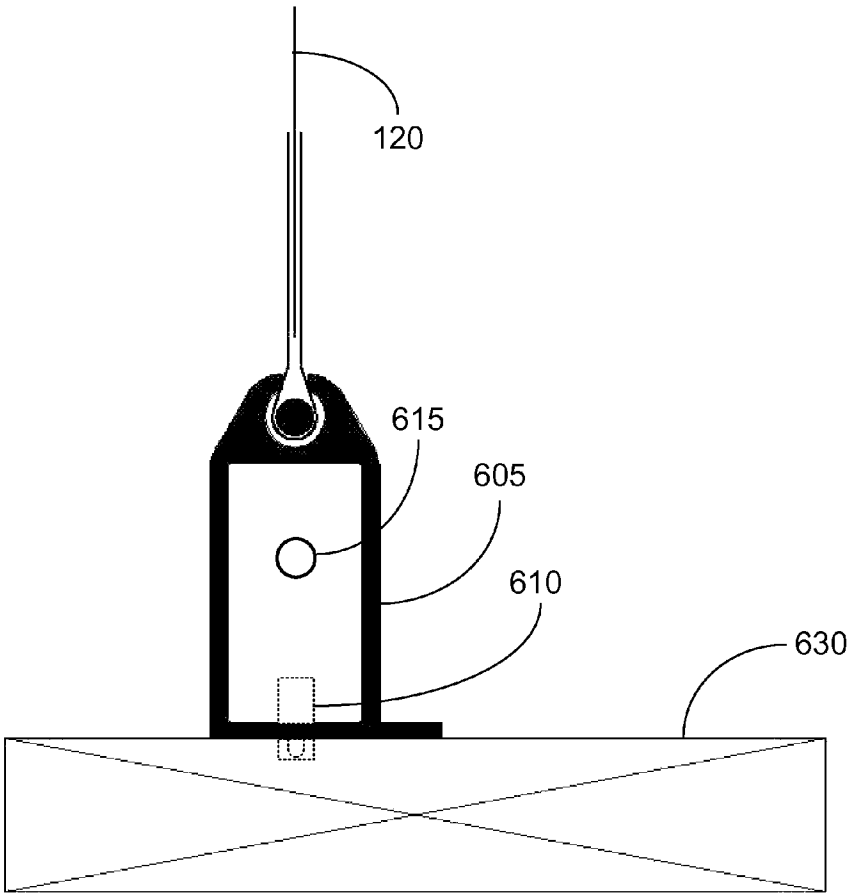
FIG. 6 depicts a side view of the screen and weight bar for the storm shield system, in accordance with some embodiments of the present invention.
Figure 7:
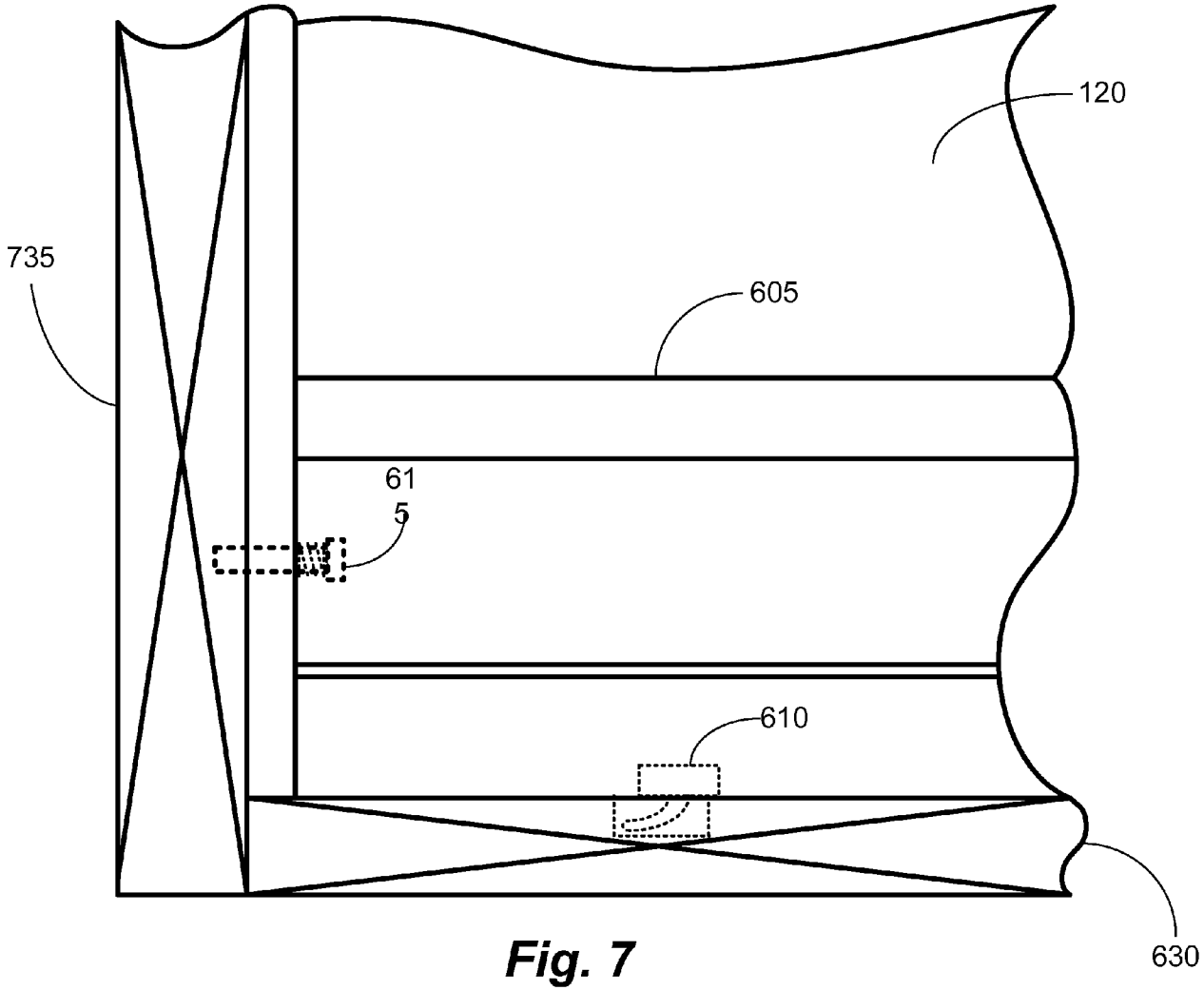
FIG. 7 depicts a detailed, front view of the screen and weight bar for the storm shield system, in accordance with some embodiments of the present invention.
Figure 9:
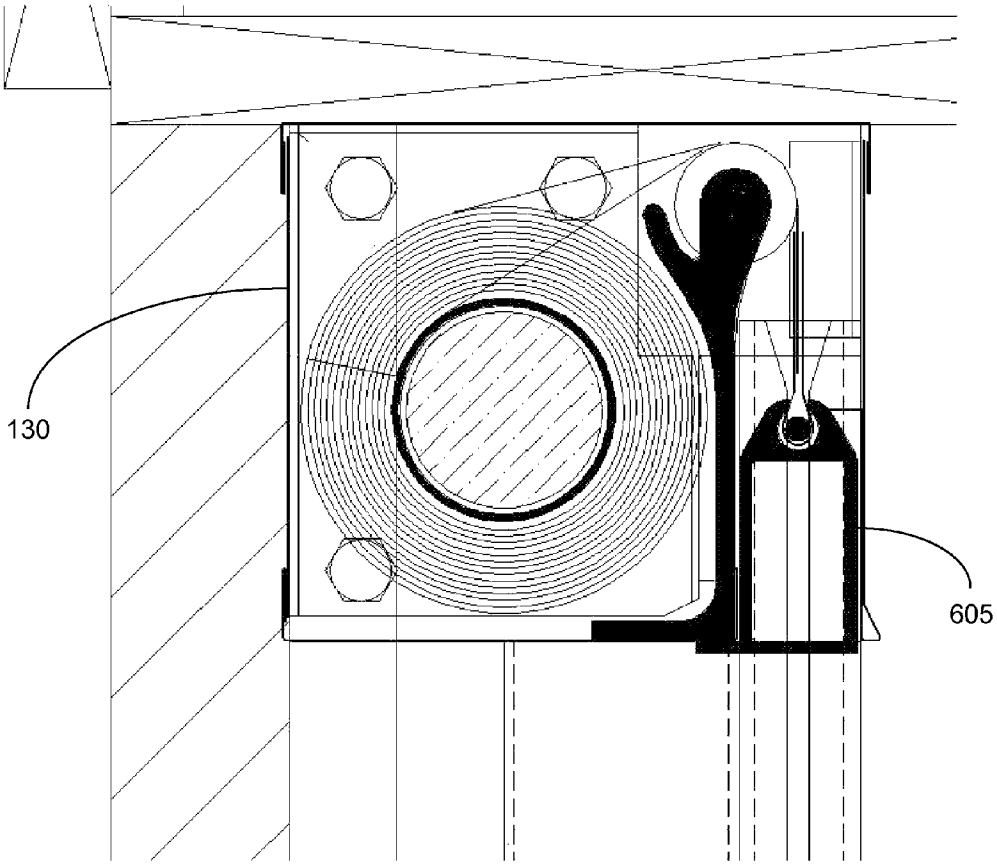
FIG. 9 depicts a cross-sectional view of the enclosure with the weight bar in a retracted position, in accordance with some embodiments of the present invention.

As shown in FIGS. 6 and 7, the system can further comprise a horizontal support unit 605. The horizontal support unit 605 can be attached to the free end of the screen 120 (i.e., opposite the end of the screen 120 that is attached to the take-up cylinder 410). When the screen 120 is fully retracted into the enclosure 130, the horizontal support unit 605 can either be fully retracted into the enclosure 130 or exposed just outside the enclosure 130. See, FIG. 9. This horizontal support unit 605 can be made of rigid materials such as, but not limited to, metal, plastic, fiberglass, composite material, wood or other compressed materials.

The horizontal support unit 605 can contain weight to assist in the deployment of the screen 120 and/or latching mechanisms 610, 615 to assist in securing the screen 120. In some embodiments, the horizontal support unit 605 can comprise locking latches 610 or pins 615 that enable the screen 120 to be secured in many positions between the fully deployed and the fully retracted position. In some embodiments, the latches 610 can, for example, engage a catch in the sill 630 of the opening. In other embodiments, pins 615 can be used to engage holes in the jambs 735 of the opening. Of course, other configurations are contemplated as other mechanisms could be used to secure the horizontal support unit 605 to the opening or the channels 110, for example. The ability to secure the horizontal support unit 605 can be useful, for example, to let fresh air in through a partially open window, while maintaining substantial protection for the opening.

In some embodiments, the system 400, 500 can further comprise a cable drive to positively deploy the screen 120. The cable system can comprise, for example, a system of cables and pulleys to move the screen 120 and/or the horizontal support unit 605 up and down rather than relying solely on gravity. This can be useful, for example, during high winds, which tend to create side forces on the screen 120, which can increase friction.

In some embodiments, the cable can be wound around the take-up cylinder 410 in the opposite direction of the screen 120. The cable can then run to a pulley located in the bottom of the extrusion 110 and back up to the screen 120. In this manner, when the take-up cylinder 410 is rotated to unfurl the screen 120 (either manually or with an electric motor, for example); the cable is wound onto the take-up cylinder 410 pulling the screen down. In some embodiments, two or more cables can be used, wound in opposite directions, to provide positive movement of the screen 120 in both directions. Of course, other cable and pulley configurations are possible and are contemplated herein.

Figure 8:
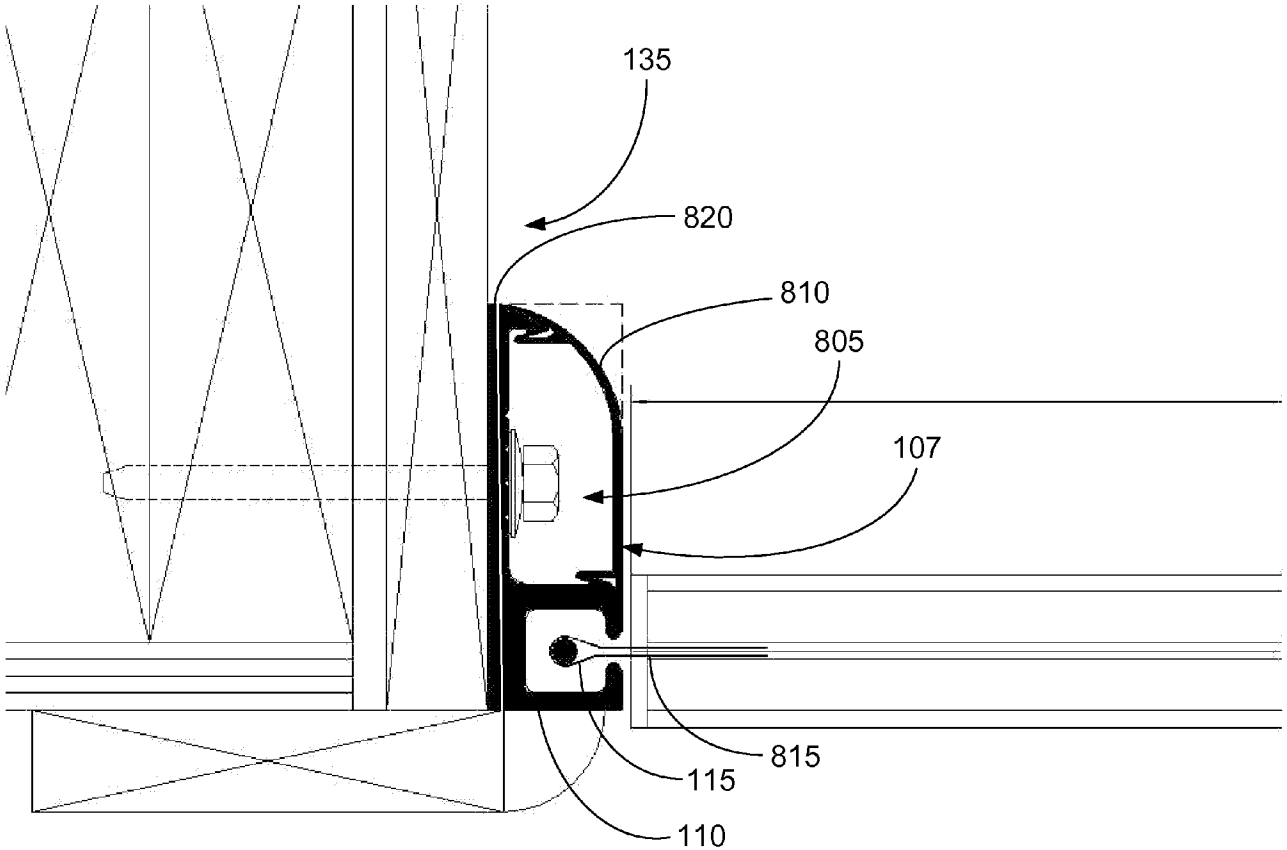
FIG. 8 depicts a top, detailed view of the retention track and cover for the storm shield system, in accordance with some embodiments of the present invention.

As shown in FIG. 8, the side support unit 107 can further define a compartment 805 sized and shaped to house remote control receivers and/or electrical connections for an electric motor. A cap, or cover, 810 can be clipped over the compartment 805 to cover the device and wires. In some embodiments, the cover 810 can be non-metallic to enable RF transmission to and from remote control receiver/transmitters. In other embodiments, the cover 810 can be transparent or translucent to enable the use of infrared remote transmitters. The cover 810 can have various profiles to meet various functional, aesthetic, or architectural needs. The cover 810 can also have various finishes to, for example and not limitation, match wall or trim colors or to simulate various finishes. The cover 810 can comprise, for example, plastic, aluminum, or pot metal, and can comprise the same material as the side support unit 107, or a different material.

The material used for the screen 120 preferably has high strength and high light transfer with reasonable visibility and clarity, while still protecting the opening from wind driven rain and missiles, among other things. In some embodiments, the screen 120 can comprise a sandwich, or bonded layers, of materials comprising, for example and not limitation, clear vinyl, Mylar®, PVC, fiberglass, or Dynema®. In some embodiments, one or more layers of the screen 120 can include a scrim comprising, for example, square, rectangle, or diamond shapes. In one preferred embodiment, the following components can be layered in the following sequence to form the screen 120 material: Clear vinyl; Mylar; a fiberglass carrier grid supporting a Dynema® scrim forming square, rectangle, or diamond shapes; and clear vinyl. This sandwich of materials can be, for example, chemically bonded (glued) or mechanically bonded using pressure, with or without heat, during the manufacturing process.

A second preferred embodiment of the screen 120 comprises a woven material comprising high-tenacity polyester threads with a PVC coating in the warp direction and a Kevlar® (or generic equivalent) with a PVC coating in the fill direction. The diameter of the vinyl and Kevlar coated yarns can vary as well as the warp and fill construction (number of threads per inch) depending on intended use. The material can be thermally set to, among other things, prevent the threads from unraveling when cut. The PVC coating can be colored. This material can provide all four capabilities, i.e., solar, insect, thermal, and storm (or, "SITS") in one material. The screen 120 can further comprise other commercially available fabric materials and can use the base material to establish the loop required for the side retention system.

In other embodiments, the vertical sides of the screens 120 can further comprise a band or edging 815 sewn vertical edges of the screen 120. In some embodiments, the edging 815 can form the loops 115. In other embodiments, the edging can be sewn over the loops 115. In some embodiments, a fabric system such as, but not limited to, Dacron® luff tape can be used to reduce friction between the loop 115, the hem rod 105, and the retention channel 110. In some embodiments, the luff tape can further comprise Teflon® thread, or other low friction materials, woven into, or adhered to, the banding for added lubricity.

In some embodiments, the side support unit 107 can further comprise closed cell foam or rubber backing 820 disposed between the side support unit 107 and the mounting surface 135 to prevent air and water leakage between side support unit 107 and the surface 135. In a preferred embodiment, the side support unit 107 can be affixed to the structure 135 using a fastener 140 with a sealing washer 145. The sealing washer 145 can comprise rubber, plastic, or other material suitable for forming a water tight seal between the fastener 140 and the side support unit 107. In a preferred embodiment, the fastener 140 can comprise a stainless steel and EPDM rubber bonded washer 145 between the head of the fastener 140 and the side support unit 107. The washer 145 can prevent both leaking and galvanic corrosion where the fastener 140 penetrates the side support unit 107 and the mounting surface 135.

Figure 10B:
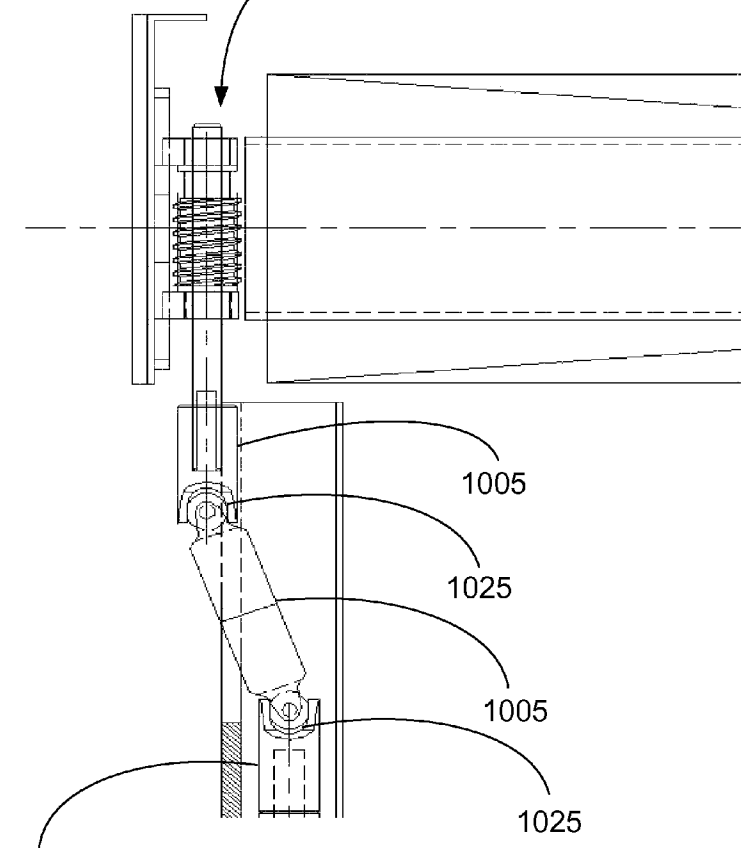
FIGS. 10*a* and 10*b* depict side and front views, respectively, of a remote drive mechanism for use with the storm shield system, in accordance with some embodiments of the present invention.
Figure 10A:
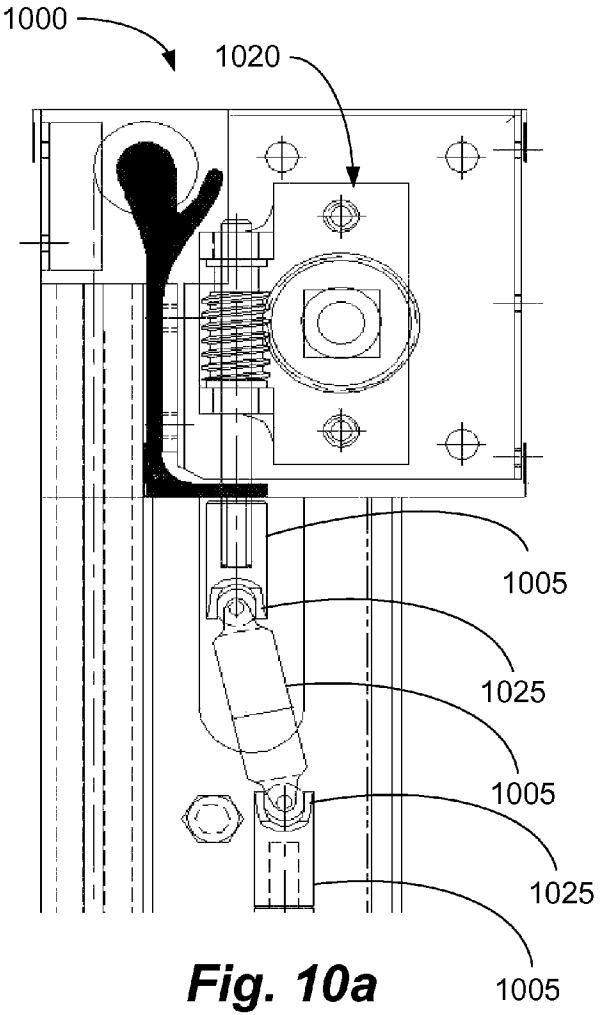

As shown in FIGS. 10*a* and 10*b*, the ability to deploy the system from the inside of the building can also be provided on an external mount installation with the proper hardware. The system can comprise a remote drive system 1000 comprising one or more driveshafts 1005 coupled to a drive mechanism 1020. In some embodiments, the driveshafts 1005 can be coupled to the drive mechanism 1020, and each other, by one or more universal joints 1025. This can enable the drive handle for the screen 120 to be remotely located. This can be useful, for example, for a very tall window to enable the drive handle to be located at a lower, safer, more convenient location. This drive system 1000 can also enable a drive motor to be located remotely from the enclosure, if desired.

Figure 11A:
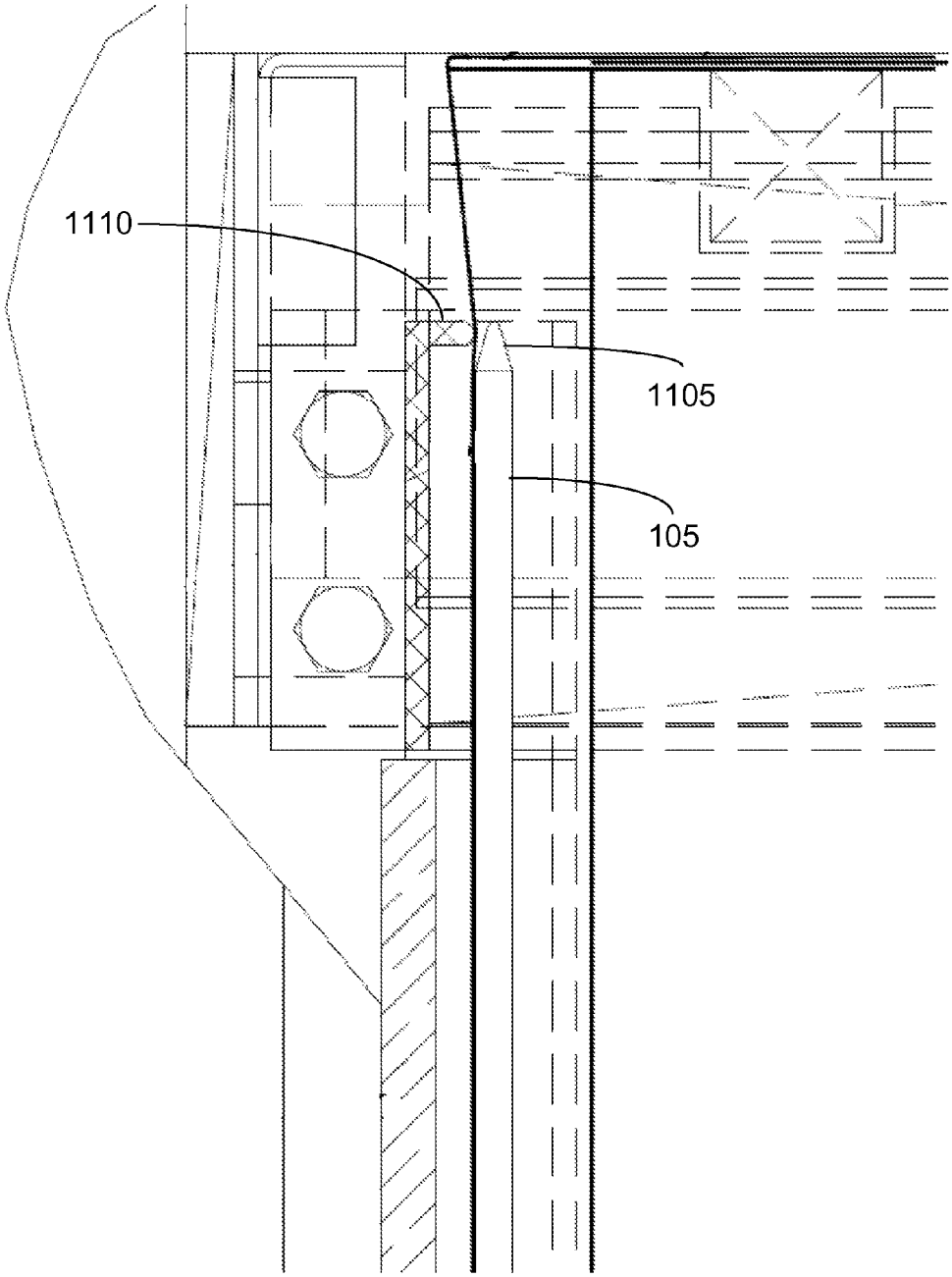
FIG. 11*a* depicts a smooth loop opener for use with the storm shield system, in accordance with some embodiments of the present invention.

When the screen 120 is wound around the take-up cylinder 410, the loop 115 sewn into the sides of the screen 120 tends to flatten. This is advantageous in that it minimizes the storage space required to store the screen 120 when not in use. When the screen 120 is deployed, however, it is desirable to open the loop 115 in the screen 120 to enable it to slide easily over the end 1105 of the hem rod 105. As shown in FIG. 11*a*, therefore, in some embodiments the system can further comprise a loop opener 1110.

The loop opener 1110 can comprise a projection, or roller, disposed in one or both retention channels, proximate the upper ends 1105 of the hem rods 105.[1] As the screen 120 is deployed past the loop opener 1110, the edge of the screen 120 is pushed inward by the loop opener 1110, causing the loop 115 to open as is comes off the roll 410. This can enable the loop 115 to start over the top 1105 of the hem rod 105 and can prevent jams and bunching during initial deployment.

[1] Of course, the loop opener would be positioned in the bottom of the retention channel in the bottom-up configuration.

In some embodiments, the end of the hem rod 105 can comprise a tapered upper portion 1105 to help start the loops 115 in the screen 120 over the end 1105 of the hem rod 105. The tapered portion 1105 can comprise a separate piece, or cap, placed on top, or inserted into the top end of the hem rod 105. In other embodiments, the tapered portion 1105 can be cast, molded, or machined into the end of the hem rod 105 such that the hem rod and the tapered portion 1105 are unitary. In some embodiments, the tapered portion 1105 can be made from the same material as the hem rod 105. In other embodiments, the tapered portion 1105 can comprise a different material than the hem rod 105 that has desirable properties such as, for example and not limitation, a low coefficient of friction. The tapered portion 1105 can be made from, for example and not limitation, metal, plastic, fiberglass, composite material, wood, or combinations thereof.

Figure 11B:
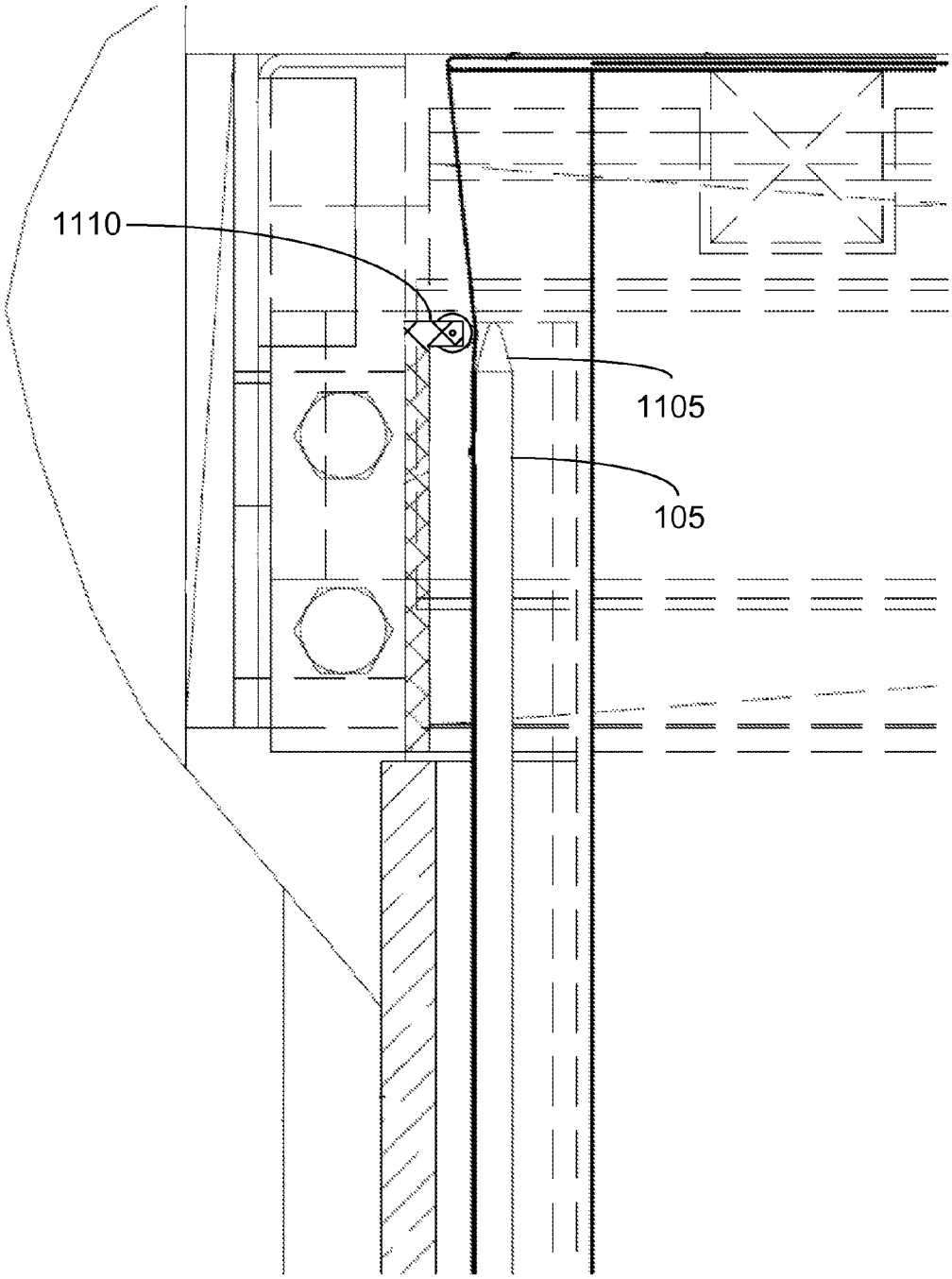
FIG. 11*b* depicts a roller loop opener for use with the storm shield system, in accordance with some embodiments of the present invention.

As shown, the loop opener 1110 can be a simple projection, or finger, disposed in the retention channel 110 near the top 1105 of the hem rod 105. The loop opener 1110 can be part of the retention channel 110 or can be a separate part affixed to the retention channel 110 during manufacture. In some embodiments, the loop opener 1110 can comprise a low-friction material or can be coated in a low-friction material to reduce wear the screen 120. As shown in FIG. 11*b*, in other embodiments, the loop opener 1110 can further comprise a wheel or ball on the end of the projection to further reduce wear on the screen 120.

Embodiments of the present invention can further comprise a method of installing the system 400 for a trapped configuration. In this configuration, the enclosure 130 can be mounted inside the window or door opening. In some embodiments, the enclosure 130 can comprise a rubber, or high-density foam, backing 420 to seal adjacent surfaces of the enclosure 130 to the mounting surface 505. The retention channels 110 can be installed on the vertical sides of the opening 405. In some embodiments, the retention channels 110 can comprise a rubber, or high-density foam, backing 425 to seal adjacent surfaces of the channels 110 to the mounting surface 405. In some embodiments, installation may further comprise installing and/or connecting remote control electronics, remote drive systems, and/or additional trim pieces.

The retention channels 110 and/or the enclosure 130 can be affixed to the structure using, for example and not limitation, screws, bolts, or rivets. In some embodiment, the fasteners 140 can further comprise a sealing washer 145 to prevent air and water leaks and galvanic corrosion between the fastener 140, channels 110, enclosure 130, and structure 505. Installation for the face-mounted configuration 500 is substantially similar with the exceptions that the enclosure 130 and channels 110 are mounted on the outside of the window or door opening, e.g., on the window trim 505.

In some embodiments, the system can be installed with the enclosure 130 on the left or right side of an opening and the retention channels 110 on the top and bottom of the opening. This may be necessary due to the type of opening or the type of window or door in the opening. The installation procedure can be substantially the same, though rotated 90 degrees in all respects. A system installed in this manner would not have the benefit of gravity, as in the top-down system, and thus may need to be manually deployed. The system would nonetheless function as intended.

Figure 12:
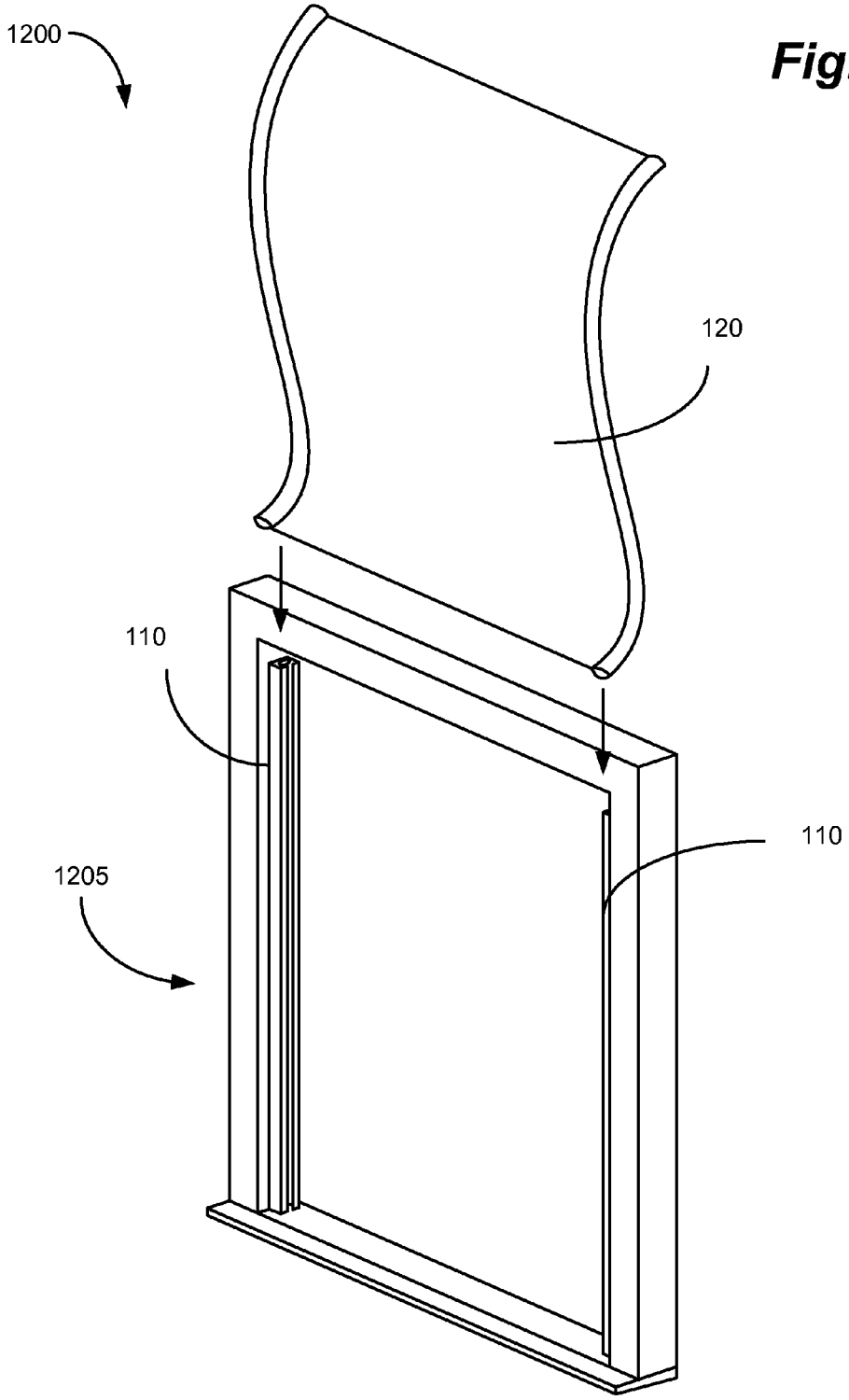
FIG. 12 depicts a manually deployed storm shield system, in accordance with some embodiments of the present invention.

As shown in FIG. 12, in still other embodiments, the system 1200 can be completely manually deployed. In other words, the system 1200 can comprise retention channels 110 and the screen 120 with no enclosure 130 or deployment mechanisms 1020. In this configuration, the user can simply install the retention channels 110 on either side of the penetration 1205, and then slide the screen 120 down over the hem rods 105 and into the retention channels 110. The screen 120 can then be secured at the bottom and/or the top of the penetration 1205 as desired.

This configuration can be useful if the subject building is, for example, a summer home. The user can deploy screen 120 over some or all of the external building penetrations at the end of the season. The user can then remove the screens 120 at the beginning of the season when reopening the house. Because there is no hem cord, the screens 120 can be stacked and stored flat, or rolled up, for storage in minimal space. In addition, because the system is somewhat simplified (e.g., there is no enclosure 130 or deployment mechanisms 1020), the cost of purchasing, installing, and maintaining the system 1200 is reduced. Finally, the aesthetic impact to the structure is minimized because, when removed, only the retention channels 110 remain on the building. In some embodiments, the retention channels 110 can also be removable, further reducing aesthetic impact.

While several possible embodiments are disclosed above, embodiments of the present invention are not so limited. For instance, while several possible configurations of materials for the screen have been disclosed, other suitable materials and combinations of materials could be selected without departing from the spirit of embodiments of the invention. In addition, the location and configuration used for various features of embodiments of the present invention can be varied according to a particular opening or building design that requires a slight variation due to, for example, the materials used and/or space or power constraints. Such changes are intended to be embraced within the scope of the invention.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A system for protecting a penetration in a building, comprising a first jamb, a second jamb, a head jamb, and a sill, the system comprising:

a first side support unit comprising a first C-shaped channel, detachably coupleable to the first jamb, comprising a first slot disposed substantially along the length of the first channel, and a first hem rod, disposed inside the channel, a first end of the hem rod fixed to a first end of the first channel;

a second side support unit comprising a second C-shaped channel, detachably coupleable to the second jamb, comprising a second slot disposed substantially along the length of the second channel, and a second hem rod, disposed inside the channel, a first end of the hem rod fixed to a first end of the second channel;

a curtain, comprising a first, retracted position and a second, deployed position, sized and shaped to cover the penetration in the second position, and comprising loops sewn along a first and second vertical edge of the curtain configured to slide over the first and second hem rods;

a take-up roll, attached to a first end of the curtain, sized and shaped to store the curtain in the first position;

a housing configured to enclose the take-up roll;

a deflector, disposed in the housing proximate the take-up roll, for maintaining the curtain in a substantially vertical orientation when the curtain is moving between the first and second positions;

a loop opener, disposed on the C-shaped channel proximate a second end of the channel, for opening a loop formed in a curtain to facilitate the curtain sliding over the end of the hem rod; and a weight bar, attached to a second end of the curtain to aid the deployment of the curtain, sized and shaped to fully retract into the housing in the first position.

2. The device of claim 1, wherein the first and second C-shaped channel and the first and second hem rod are formed from a unitary piece of material.

3. The device of claim 2, wherein the first and second C-shaped channel and the first and second hem rod are extruded from aluminum.

4. The device of claim 1, the first and second hem rod further comprising a tapered first end to facilitate the curtain sliding over the end of the hem rod.

5. The device of claim 1, wherein the loop opener comprises a roller.

6. The system of claim 1, wherein the first slot faces the second slot.

7. The system of claim 1, further comprising a drive system comprising:

one or more driveshafts;

one or more universal joints for connecting the one or more driveshafts; and a drive gear for engaging a driven gear on the take up roll;

wherein rotating the one or more driveshafts in a first direction rolls the curtain onto the take up roll; and wherein rotating the one or more driveshafts in a second direction rolls the curtain off of the take up roll.

8. The system of claim 7, wherein the drive gear and the driven gear are a worm gear set.

9. The system of claim 7, wherein the drive gear and the driven gear are a bevel gear set.

10. The system of claim 7, further comprising a drive motor removably coupled to the one or more driveshafts to drive the one or more driveshafts.

11. The system of claim 1, the curtain further comprising edging affixed to the first and second vertical sides of the curtain;

wherein the edging comprises a lower friction material than the curtain.

12. The system of claim 1, wherein the curtain comprises a composite material comprising two or more layers.

13. The system of claim 1, the side support units further comprising a cover, the first and second side support unit and the cover defining a compartment.

14. The system of claim 1, wherein the deflector comprises a roller.

15. The system of claim 1, wherein the deflector comprises a smooth, rounded surface.

16. The system of claim 1, wherein the loop opener comprises a smooth projection.

* * * * *